US010128976B2

(12) United States Patent
Shibohta et al.

(10) Patent No.: US 10,128,976 B2
(45) Date of Patent: Nov. 13, 2018

(54) RADIO WAVE JAMMING SYSTEM, RADIO WAVE JAMMING APPARATUS, AND RADIO WAVE JAMMING METHOD

(71) Applicant: NEC Corporation, Minato-ku, Tokyo (JP)

(72) Inventors: Hideto Shibohta, Tokyo (JP); Shigeru Asai, Tokyo (JP); Kenji Wakafuji, Tokyo (JP); Masakazu Ono, Tokyo (JP); Shingo Watanabe, Tokyo (JP); Masato Kudou, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 15/327,077

(22) PCT Filed: May 27, 2015

(86) PCT No.: PCT/JP2015/002675
§ 371 (c)(1),
(2) Date: Jan. 18, 2017

(87) PCT Pub. No.: WO2016/013140
PCT Pub. Date: Jan. 28, 2016

(65) Prior Publication Data

US 2017/0163372 A1 Jun. 8, 2017

(30) Foreign Application Priority Data

Jul. 22, 2014 (JP) ..... 2014-148698

(51) Int. Cl.
*H04K 3/00* (2006.01)

(52) U.S. Cl.
CPC ..... *H04K 3/44* (2013.01); *H04K 3/00* (2013.01); *H04K 3/41* (2013.01); *H04K 3/42* (2013.01); *H04K 2203/34* (2013.01)

(58) Field of Classification Search
None
See application file for complete search history.

(56) References Cited

U.S. PATENT DOCUMENTS 3,879,732 A * 4/1975 Simpson ..... G01S 7/38 342/14
4,467,328 A * 8/1984 Hacker ..... G01S 7/38 342/14

(Continued)

FOREIGN PATENT DOCUMENTS

EP 2387170 A1 11/2011
JP H02-060245 A 2/1990

(Continued)

OTHER PUBLICATIONS

International Search Report for PCT Application No. PCT/JP2015/002675, dated Jul. 7, 2015.

(Continued)

*Primary Examiner* — David Bilodeau

(57) ABSTRACT

A radio wave jamming system (1) comprises a plurality of radio transmitters (10) that are adapted to transmit respective jamming signals (11) including substantially the same frequency. The plurality of radio transmitters (10) are further adapted to temporally change at least one of the transmission phases of the jamming signals (11), which are to be transmitted from the plurality of radio transmitters (10), so as to temporally change the phase differences among the jamming signals (11) when the jamming signals (11) transmitted from the plurality of radio transmitters (10) arrive at a particular site (50). Thus, for example, a radio wave jamming system that can be constituted by small-output radio devices can be provided.

19 Claims, 2 Drawing Sheets

(56) References Cited

U.S. PATENT DOCUMENTS

| | | | | |
|---|---|---|---|---|
| 2010/0283656 | A1* | 11/2010 | Zavrel, Jr. | G01S 7/38 342/14 |
| 2010/0304661 | A1 | 12/2010 | Cornwell | |
| 2012/0327985 | A1* | 12/2012 | Norris | G01S 7/38 375/221 |
| 2013/0315341 | A1 | 11/2013 | Couillard et al. | |
| 2014/0206279 | A1* | 7/2014 | Immendorf | H04K 3/40 455/1 |
| 2015/0244495 | A1* | 8/2015 | Kang | H04K 3/827 455/1 |
| 2015/0256286 | A1* | 9/2015 | Johnson | H04K 3/228 455/1 |
| 2017/0074986 | A1* | 3/2017 | Chang | G10K 11/178 |

FOREIGN PATENT DOCUMENTS

| | | | |
|---|---|---|---|
| JP | H06-331730 | A | 12/1994 |
| JP | H07-154299 | A | 6/1995 |
| JP | 2001-235535 | A | 8/2001 |
| JP | 2002-148330 | A | 5/2002 |
| JP | 2012-178704 | A | 9/2012 |
| JP | 2013-197631 | A | 9/2013 |
| WO | 2010/078402 | A1 | 7/2010 |

OTHER PUBLICATIONS

English translation of Written opinion for PCT Application No. PCT/JP2015/002675.

Extended European Search Report for EP Application No. EP15825027.4 dated Feb. 7, 2018.

* cited by examiner

RADIO WAVE JAMMING SYSTEM, RADIO WAVE JAMMING APPARATUS, AND RADIO WAVE JAMMING METHOD

This application is a National Stage Entry of PCT/JP2015/002675 filed on May 27, 2015, which claims priority from Japanese Patent Application 2014-148698 filed on Jul. 22, 2014, the contents of all of which are incorporated herein by reference, in their entirety.

TECHNICAL FIELD

The disclosure of the present specification relates to a radio wave jamming technique for jamming radio communication.

BACKGROUND ART

It is known as one of radio wave jamming techniques that a radio signal (jamming wave or jamming signal) is transmitted to thereby intentionally jam radio communication (for example, refer to the PTLs 1 to 4). Such radio wave jamming is referred to as communications jamming, radio jamming, or the like.

CITATION LIST

Patent Literature

[PTL 1] Japanese Patent Application Laid-open publication No. 2013-197631

[PTL 2] Japanese Patent Application Laid-open publication No. 2012-178704

[PTL 3] Japanese Patent Application Laid-open publication No. H7-154299

[PTL 4] Japanese Patent Application Laid-open publication No. H6-331730

SUMMARY OF INVENTION

Technical Problem

A radio wave jamming apparatus for communication jamming needs to generate a high-power jamming signal in order to effectively degrade a signal-to-noise ratio (SNR) of a radio communication signal related to radio communication between other apparatuses. For this reason, there is an issue that the radio wave jamming apparatus needs a high-power amplifier, and a size of the apparatus is large.

The PTL 3 discloses that a phase of an jamming signal transmitted from a radio wave jamming apparatus is randomly changed on a cycle whose slowness is at a level of fading. The PTL 3 however describes only that jamming is given to communication of a jamming target by one radio wave jamming apparatus. In other words, in the PTL3, there is no disclosure that interaction of a plurality of jamming signals transmitted from a plurality of radio wave jamming apparatuses is used to give jamming to communication of a jamming target.

The PTL 4 discloses use of two radio wave jamming apparatuses, namely, an installation type of radio wave jamming apparatus and an injection molded type of radio wave jamming apparatus. The installation type of radio wave jamming apparatus and the injection molded type of radio wave jamming apparatus however simply generate jamming signals with regard to jamming targets (opponent radio wave source A and opponent radio wave source B) different from each other. In other words, also in the PTL 4, there is no disclosure that interaction of a plurality of jamming signals transmitted from a plurality of radio wave jamming apparatuses is used to give jamming to communication of a jamming target.

For this reason, one object to be attained by an exemplary embodiment disclosed in the present specification is to provide a radio wave jamming system, a radio wave jamming apparatus, and a radio wave jamming method that enable their configuration to be made with low-power radio devices. It should be noted that this object is no more than one of a plurality of objects to be attained by exemplary embodiments disclosed in the present specification. Other objects or problems and new features become apparent from the description in the present specification or the accompanying drawings.

Solution to Problem

In an embodiment, a radio wave jamming system comprises a plurality of radio transmitters configured to transmit a plurality of jamming signals, each jamming signal containing substantially same frequency. The plurality of radio transmitters are configured to temporally change a transmission phase of at least one of the plurality of jamming signals so as to temporally change a phase difference among the plurality of jamming signals when the plurality of the jamming signals transmitted from the plurality of radio transmitters arrive at a particular spot.

In an embodiment, a radio wave jamming apparatus comprises a transmitter and a control unit. The transmitter is configured to transmit a second jamming signal having substantially same frequency as that of a first jamming signal transmitted from another radio wave jamming apparatus. The control unit is configured to temporally change a transmission phase of the second jamming signal transmitted by the transmitter so as to temporally change a phase difference between the first jamming signal and the second jamming signal when the first jamming signal and second jamming signal arrive at a particular spot.

In an embodiment, a radio wave jamming method comprises (a) transmitting from a plurality of radio transmitters a plurality of jamming signals containing substantially same frequency and (b) temporally changing a transmission phase of at least one of the plurality of jamming signals transmitted from the plurality of radio transmitters so as to temporally change a phase difference among the plurality of jamming signals when the plurality of jamming signals arrive at a particular spot.

Advantageous Effect of Invention

According to the above-described exemplary embodiments, it is possible to provide a radio wave jamming system, a radio wave jamming apparatus, and a radio wave jamming method that enable their configuration to be made with low-power radio devices.

DESCRIPTION OF EMBODIMENTS

The following describes concrete exemplary embodiments in detail with reference to the drawings. In the respective drawings, the same reference symbols are attached to the same or corresponding elements, and for clarifying the description, duplicate description is omitted in accordance with necessity.

First Exemplary Embodiment

Figure 1:
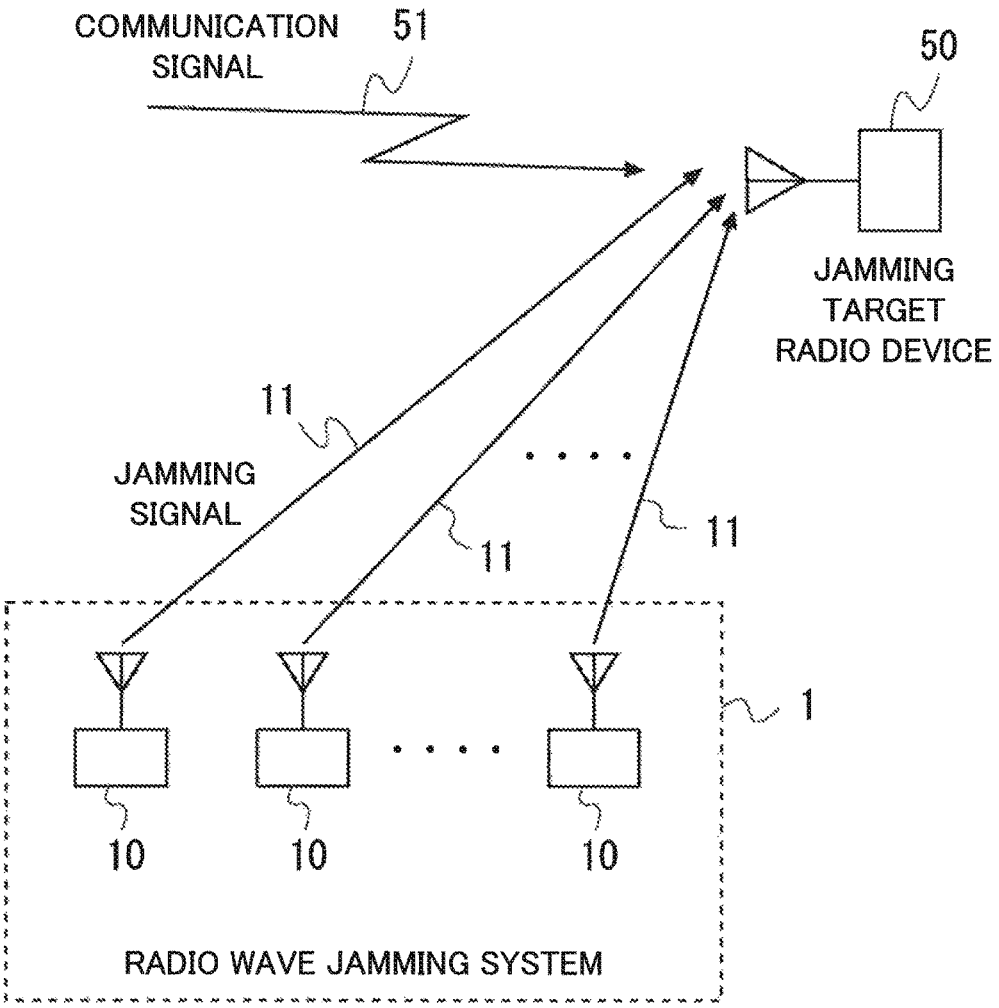
FIG. 1 illustrates one example of a configuration of a radio wave jamming system according to an exemplary embodiment of the present invention.

FIG. 1 illustrates a configuration example of a radio wave jamming system 1 according to an exemplary embodiment of the present invention.

The radio wave jamming system 1 includes a plurality of radio wave jamming apparatuses 10. Each of the plurality of radio wave jamming apparatuses 10 includes a radio transmitter configured to transmit a jamming signal 11 containing substantially the same frequency.

It is sufficient that the jamming signal 11 includes a same frequency component as in a spectrum of a communication signal 51 received by a jamming target apparatus 50. The jamming signal 11 may also include a plurality of frequency components that can be used in the communication signal 51. In the case of aiming at degrading an SNR of the communication signal 51 (jamming the communication signal 51), the jamming signal 11 does not need to be a modulated signal, and may be a non-modulated sinusoidal signal. When a frequency of the communication signal 51 is changed by frequency hopping, the radio wave jamming apparatus 10 may change a frequency of the jamming signal 11, following the frequency hopping of the communication signal 51.

Without particular limitation, various known methods can be used as a method of matching a frequency of the jamming signal 11 to a frequency of the communication signal 51. In one example, as described in the PTL 2, the radio wave jamming apparatus 10 may receive the communication signal 51, detect a frequency of the communication signal 51, and generate the jamming signal 11 including a frequency component included in the communication signal 51. In another example, the radio wave jamming apparatus 10 may receive from a remote control device (not illustrated) a control signal for designating a frequency of the jamming signal 11.

A plurality of jamming signals 11 transmitted from the plurality of radio wave jamming apparatuses 10 travel through different routes, and arrive at an antenna of the jamming target apparatus 50 to jam reception of the communication signal 51 by the jamming target apparatus 50. The plurality of jamming signals 11 containing the same frequency interfere with each other and generate a composite wave at the spot of the jamming target apparatus 50, in accordance with the superposition principle of waves.

Here, it should be noted that an amplitude of the composite wave depends on one or more phase difference among the plurality of jamming signals 11 at the time of the arrival at the spot of the jamming target apparatus 50. In other words, when most of the plurality of jamming signals 11 are approximately in phase at the spot of the jamming target apparatus 50, the plurality of jamming signals 11 produce constructive interference where the signals are intensified by each other so that an amplitude of the composite wave is increased, accordingly enabling effective degradation of an SNR of the communication signal 51. On the contrary, when most of a plurality of jamming signals 11 are approximately out of phase at the spot of the jamming target apparatus 50, the plurality of jamming signals 11 produce destructive interference where the signals are weakened by each other so that an amplitude of the composite wave stays at a level of a sum of average electric power of the plurality of jamming signals 11, and accordingly, an SNR of the communication signal 51 may not be sufficiently degraded.

In order to avoid the above-described issue that depends on spatial relationship between the plurality of radio wave jamming apparatuses 10 and the jamming target apparatus 50, the plurality of radio wave jamming apparatuses 10 operate such that a phase difference between a plurality of jamming signals 11 at the time of arriving at the spot of the jamming target apparatus 50 is temporally changed. Concretely, in order that a phase difference between a plurality of jamming signals 11 at the time of arriving at the spot of the jamming target apparatus 50 is temporally changed, at least one of a plurality of radio wave jamming apparatuses 10 is configured to temporally change a transmission phase of the jamming signal 11. A phase difference between a plurality of jamming signals 11 is adjusted so that superposition of these signals can temporally change a spot where an amplitude of the composite wave is increased. Thus, it is certain that there comes the timing that the plurality of jamming signals 11 produce the constructive interference at the spot of the jamming target apparatus 50. For this reason, the radio wave jamming system 1 of the present exemplary embodiment can jam reception of the communication signal 51 at the timing that the plurality of jamming signals 11 produce the constructive interference at the spot of the jamming target apparatus 50.

Further, the radio wave jamming system 1 of the present exemplary embodiment can reduce transmission electric power of the individual radio wave jamming apparatuses 10. This is because in the present exemplary embodiment, the composite amplitude of the plurality of jamming signals 11 contributes to degradation of the SNR of the communication signal 51, and accordingly, the amplitude of each jamming signal 11 can be reduced to relatively small value. Thus, because it is unnecessary to generate a high-power jamming signal, each radio wave jamming apparatus 10 can be constituted by a low-power radio device.

Next, the following describes some concrete examples of a method of temporally changing a transmission phase of the jamming signal 11. As already described above, at least one of a plurality of radio wave jamming apparatuses 10 temporally changes a transmission phase of the jamming signal 11 (changes this transmission phase each moment in accordance with lapse of time). At least two or all of a plurality of radio wave jamming apparatuses 10 may temporally change transmission phases of the jamming signals 11.

Preferably, the timing that an amplitude of the composite wave of a plurality of jamming signals 11 is increased at the spot of the jamming target apparatus 50 cannot be predicted. This is because if this timing can be predicted, the jamming target apparatus 50 can take a counter measure such as stopping of communication at this timing. In order to reduce predictability of the timing that an amplitude of the composite wave of a plurality of jamming signals 11 is increased at the spot of the jamming target apparatus 50, a plurality of radio wave jamming apparatuses 10 may operate as follows.

In a first example, at the time of changing the transmission phase of the jamming signal 11, each radio wave jamming apparatus 10 may randomly change a transmission phase of the jamming signal 11. Thereby, an amplitude of the composite wave of a plurality of jamming signals 11 is non-periodically increased at the spot of the jamming target apparatus 50.

In a second example, each radio wave jamming apparatus 10 may change time intervals at which the transmission phase of the jamming signal 11 is changed. For example, two radio wave jamming apparatuses included in a plurality of radio wave jamming apparatuses 10 may change transmission phases of the jamming signals 11 at time intervals different from each other. More concretely, each radio wave jamming apparatus 10 may change a transmission phase of the jamming signal 11 at random time intervals. Thereby, an amplitude of the composite wave of a plurality of jamming signals 11 is non-periodically increased at the spot of the jamming target apparatus 50.

When the above-described first example is applied, each radio wave jamming apparatus 10 may change a transmission phase periodically (i.e., at fixed time intervals). When the above-described second example is applied, each radio wave jamming apparatus 10 may change a transmission phase regularly at each change timing (e.g., shift a transmission phase by a fixed phase amount). Meanwhile, the above-described first and second examples may be used together. In other words, each radio wave jamming apparatus 10 may (e.g., randomly) change time intervals at which a transmission phase of the jamming signal 11 is changed, and randomly change a transmission phase of the jamming signal 11. This can further reduce predictability of the timing that an amplitude of the composite wave of a plurality of jamming signals 11 is increased at the spot of the jamming target apparatus 50.

Further, as understood from the foregoing description, according to the present exemplary embodiment, it is sufficient that each radio wave jamming apparatus 10 temporally changes a transmission phase of its own jamming signal 11 independently without synchronization with change of transmission phases of the jamming signals 11 by other radio wave jamming apparatuses 10. Accordingly, the radio wave jamming system 1 of the present exemplary embodiment does not need a device that strictly controls a transmission phase of each radio wave jamming apparatus 10, and does not need means for communication between radio wave jamming apparatuses 10 as well. In other words, each radio wave jamming apparatus 10 may transmit the jamming signal 11 without communicating with other radio wave jamming apparatuses 10. Thereby, an apparatus configuration can be simplified more than a configuration including a device for making communication between the radio wave jamming apparatuses 10.

A plurality of radio wave jamming apparatuses 10 (radio transmitters) may be arranged at different sites geographically separated from each other. Thereby, even when the radio wave jamming apparatus 10 arranged at the specific site cannot be used for some reason, the remaining radio wave jamming apparatuses 10 arranged at the other sites are used so that radio wave jamming can be continued.

Further, at least one of a plurality of radio wave jamming apparatuses 10 (radio transmitters) may temporally change a state between modulation and non-modulation or a bandwidth of the jamming signal 11, or both thereof. At least two or all of a plurality of radio wave jamming apparatuses 10 may temporally change states between modulation and non-modulation or bandwidths of the jamming signals 11, or both thereof. In this case, the radio wave jamming apparatuses 10 may transmit modulated sinusoidal signals as the jamming signals 11. By temporally changing states between modulation and non-modulation or bandwidths of the jamming signals 11, or both thereof, the radio wave jamming system 1 can contribute to attainment of effective jamming even when a communication bandwidth of the jamming target apparatus 50 is unknown, even when a communication bandwidth of the jamming target apparatus 50 changes, or even when a communication bandwidth of the jamming target apparatus 50 is wide. This is because the modulated jamming signals 11 have wider spectra (i.e., wider occupied bandwidths) than before the modulation so that jamming can be inflicted over the wide frequency band. Further, changing bandwidths (occupied bandwidths) of the jamming signals 11 can also inflict jamming over the wide frequency band.

The radio wave jamming apparatus 10 may temporally change a state between modulation and non-modulation or a bandwidth of its own jamming signal 11, or both thereof independently without synchronization with change of a state between modulation and non-modulation, and bandwidths of the jamming signals 11 by other radio wave jamming apparatuses 10. The radio wave jamming apparatus 10 may change a state between modulation and non-modulation or a bandwidth of its own jamming signal 11, or both thereof at time intervals different from those by other radio wave jamming apparatuses 10. The radio wave jamming apparatuses 10 may change states between modulation and non-modulation or bandwidths of their own jamming signals 11, or both thereof at random time intervals or periodically. The radio wave jamming apparatuses 10 may randomly change bandwidths of their own jamming signals 11. This can reduce predictability of the timing that a frequency band of the composite wave of a plurality of jamming signals 11 coincides with a frequency band of the jamming signal 11 at the spot of the jamming target apparatus 50.

Figure 2:
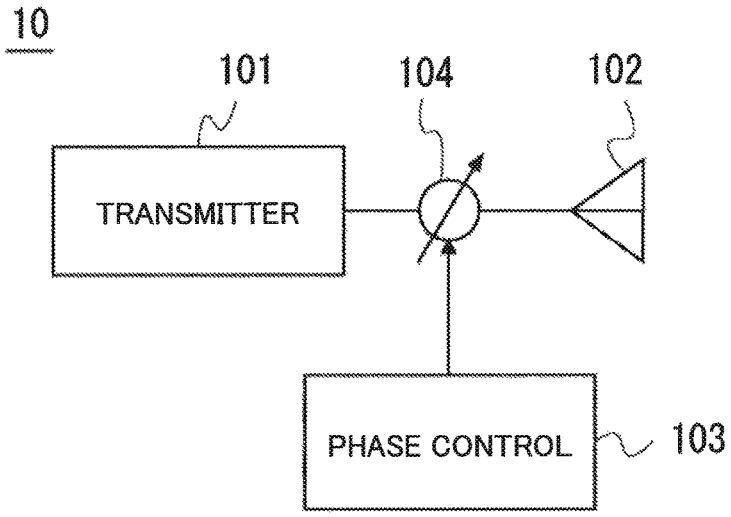
FIG. 2 illustrates one example of a configuration of a radio wave jamming apparatus according to the exemplary embodiment of the present invention.

Next, a configuration example of each radio wave jamming apparatus 10 is described in the following. FIG. 2 illustrates the configuration example of the radio wave jamming apparatus 10. In the example of FIG. 2, the radio wave jamming apparatus 10 includes a transmitter 101, an antenna 102, a phase control unit 103, and a variable phase-shifter 104. The transmitter 101 is configured to generate the jamming signal 11, and transmit the jamming signal 11 via the antenna 102. In one example, the transmitter 101 may generate a non-modulated sinusoidal signal as the jamming signal 11. In another example, the transmitter 101 may include a modulator, and generate a modulated sinusoidal signal as the jamming signal 11. In this case, the transmitter 101 may temporally change a state between modulation and non-modulation or a bandwidth of the jamming signal 11, or both thereof.

The antenna 102 may be a nondirectional antenna or a directional antenna. The antenna 102 may be a phased-array antenna, a sector switched antenna, or a mechanical direction-variable antenna that can perform beam forming.

The phase control unit 103 is connected to the variable phase-shifter 104, and controls the variable phase-shifter 104 to temporally change a transmission phase of the jamming signal 11. The variable phase-shifter 104 changes a phase of the jamming signal 11, which is radiated from the antenna 102. For example, the variable phase-shifter 104 may be analogue phase-shifter or a digital phase-shifter. The variable phase-shifter 104 may include a time delay device that gives a real time delay to the jamming signal 11 to be provided to the antenna 102.

The above-described exemplary embodiment is no more than an example relating to application of a technical idea gained by inventors of the present patent application. In other words, the technical idea is not limited only to the above-described exemplary embodiments, and various changes can be surely made.

The present patent application claims priority based on Japanese patent application No. 2014-148698 filed on Jul. 22, 2014, the entire disclosure of which is incorporated herein.

REFERENCE SIGNS LIST

1 Radio wave jamming system
10 Radio wave jamming apparatus
11 Jamming signal
101 Transmitter
102 Antenna
103 Phase control unit
104 Variable phase-shifter

What is claimed is:

1. A radio wave jamming system comprising:

a plurality of radio transmitters configured to transmit a plurality of jamming signals, each jamming signal containing substantially same frequency, wherein the plurality of radio transmitters temporally change a transmission phase of at least one of the plurality of jamming signals so as to temporally change a phase difference among the plurality of jamming signals when the plurality of the jamming signals transmitted from the plurality of radio transmitters arrive at a particular spot, and wherein the plurality of radio transmitters include:

a first radio transmitter configured to transmit a first jamming signal containing the frequency, and temporally change a transmission phase of the first jamming signal; and a second radio transmitter configured to transmit a second jamming signal containing the frequency, and temporally change a transmission phase of the second jamming signal independently without synchronization with change of the transmission phase of the first jamming signal by the first radio transmitter.

2. The radio wave jamming system according to claim 1, wherein the plurality of radio transmitters transmit the plurality of jamming signals without communication between the plurality of radio transmitters.

3. The radio wave jamming system according to claim 1, wherein the plurality of radio transmitters further temporally change a state between modulation and non-modulation or a bandwidth of at least one of the plurality of jamming signals, or both thereof.

4. The radio wave jamming system according to claim 1, wherein the first transmitter and the second radio transmitter change the transmission phases of the first jamming signal and the second jamming signal at time intervals different from each other.

5. The radio wave jamming system according to claim 1, wherein the first radio transmitter changes the transmission phase of the first jamming signal at random time intervals.

6. The radio wave jamming system according to claim 1, wherein the first radio transmitter changes the transmission phase of the first jamming signal periodically.

7. The radio wave jamming system according to claim 1, wherein at time of changing the transmission phase of the first jamming signal, the first radio transmitter randomly changes a transmission phase of the first jamming signal.

8. The radio wave jamming system according to claim 1, wherein the first radio transmitter is further configured to transmit a first jamming signal containing the frequency, and temporally change a state between modulation and non-modulation or a bandwidth of the first jamming signal, or both thereof; and the second radio transmitter is further configured to transmit a second jamming signal containing the frequency, and temporally change a state between modulation and non-modulation or a bandwidth of the second jamming signal, or both thereof independently without synchronization with change of the state between modulation and non-modulation and the bandwidth of the first jamming signal by the first radio transmitter.

9. The radio wave jamming system according to claim 8, wherein the first radio transmitter and the second radio transmitter change states between modulation and non-modulation or the bandwidths of the first jamming signal and the second jamming signal, or both thereof at time intervals different from each other.

10. The radio wave jamming system according to claim 8, wherein the first radio transmitter changes the state between modulation and non-modulation or the bandwidth of the first jamming signal, or both thereof at random time intervals.

11. The radio wave jamming system according to claim 8, wherein the first radio transmitter periodically changes the state between modulation and non-modulation or the bandwidth of the first jamming signal, or both thereof.

12. The radio wave jamming system according to claim 8, wherein at time of changing the state between modulation and non-modulation or the bandwidth of the first jamming signal, or both thereof, the first radio transmitter randomly changes a bandwidth of the first jamming signal.

13. The radio wave jamming system according to claim 1, wherein the plurality of radio transmitters are arranged to be geographically separated from each other.

14. The radio wave jamming system according to claim 1, wherein each of the plurality of jamming signals includes a non-modulated or modulated sinusoidal signal containing the same frequency.

15. A radio wave jamming apparatus comprising:

a second transmitter configured to transmit a second jamming signal having substantially same frequency as that of a first jamming signal transmitted from a first radio wave jamming apparatus; and a controller for temporally changing a transmission phase of the second jamming signal transmitted by the second transmitter so as to temporally change a phase difference between the first jamming signal and the second jamming signal when the first jamming signal and the second jamming signal arrive at a particular spot, wherein the first radio transmitter is configured to transmit the first jamming signal containing the frequency, and temporally change a transmission phase of the first jamming signal; and wherein the controller is further for temporally changing the transmission phase of the second jamming signal independently without synchronization with change of the transmission phase of the first jamming signal by the first radio transmitter.

16. The radio wave jamming apparatus according to claim 15, wherein the controller and the transmitter transmit the first jamming signal without communicating with the another radio wave jamming apparatus.

17. The radio wave jamming apparatus according to claim 15, wherein the controller further temporally changes a state between modulation and non-modulation or a bandwidth of the second jamming signal, or both thereof.

18. The radio wave jamming apparatus according to claim 15, wherein the controller temporally changes the transmission phase of the second jamming signal independently without synchronization with change of the transmission phase of the first jamming signal by the another radio wave jamming apparatus.

19. A radio wave jamming method comprising:

transmitting from a plurality of radio transmitters a plurality of jamming signals containing substantially same frequency; and temporally changing a transmission phase of at least one of the plurality of jamming signals transmitted from the plurality of radio transmitters so as to temporally change a phase difference among the plurality of jamming signals when the plurality of jamming signals arrive at a particular spot, wherein transmitting from the plurality of radio transmitters comprises:

transmitting from a first radio transmitter a first jamming signal containing the frequency, and temporally change a transmission phase of the first jamming signal; and transmitting from a second radio transmitter a second jamming signal containing the frequency, and temporally change a transmission phase of the second jamming signal independently without synchronization with change of the transmission phase of the first jamming signal by the first radio transmitter.

* * * * *